US007886941B2

(12) United States Patent
Pietrowski et al.

(10) Patent No.: US 7,886,941 B2
(45) Date of Patent: Feb. 15, 2011

(54) DISPENSER HAVING AIR TIGHT SPOUT

(75) Inventors: Daria Pietrowski, Huntington Beach, CA (US); Lluis Costa, Hacienda Heights, CA (US); Robert Radi, Beverly Hills, CA (US)

(73) Assignee: Meadwestvaco Calmar Inc., Grandview, MO (US)

( * ) Notice: Subject to any disclaimer, the term of this patent is extended or adjusted under 35 U.S.C. 154(b) by 749 days.

(21) Appl. No.: 11/113,132

(22) Filed: Apr. 25, 2005

(65) Prior Publication Data

US 2006/0237491 A1 Oct. 26, 2006

(51) Int. Cl.
*B65B 35/38* (2006.01)

(52) U.S. Cl. ..... 222/494; 222/380; 222/490; 222/321.7

(58) Field of Classification Search ... 222/321.7–321.9, 222/383.1, 383.3, 490, 494, 380; 215/260
See application file for complete search history.

(56) References Cited

U.S. PATENT DOCUMENTS

| | | | |
|---|---|---|---|
| 2,792,149 | A | 5/1957 | Lutz |
| 3,884,396 | A | 5/1975 | Gordon et al. |
| 4,051,983 | A | 10/1977 | Anderson |
| 4,513,891 | A | 4/1985 | Hain et al. |
| D291,972 | S | 9/1987 | Pfeiffer |
| D314,149 | S | 1/1991 | Guilbert |
| 5,186,368 | A | 2/1993 | Garcia |
| 5,377,877 | A | 1/1995 | Brown et al. |
| 5,447,258 | A | 9/1995 | Suzuki |
| 5,518,377 | A | 5/1996 | Bougamont et al. |
| 5,687,884 | A | 11/1997 | Bodin et al. |
| 5,819,990 | A | 10/1998 | Cimentepe et al. |
| 5,950,878 | A | 9/1999 | Wade et al. |
| 6,016,939 | A | 1/2000 | Gueret |
| D419,878 | S | 2/2000 | Kerr et al. |
| D420,288 | S | 2/2000 | Garcia |
| 6,026,993 | A | 2/2000 | Sperna Weiland |
| 6,065,642 | A | 5/2000 | Brown |
| D429,642 | S | 8/2000 | Garcia |
| 6,145,707 | A | 11/2000 | Baudin |
| D439,842 | S | 4/2001 | Garcia |

(Continued)

FOREIGN PATENT DOCUMENTS

| | | | |
|---|---|---|---|
| EP | 0696480 | A1 | 2/1996 |

(Continued)

*Primary Examiner*—J. Casimer Jacyna
(74) *Attorney, Agent, or Firm*—MWV Intellectual Property Group

(57) ABSTRACT

A spout valve assembly, for a pump dispenser including a discharge head, is located within an opening in the discharge head for permitting outletting of liquid product and includes a spout valve retained within the discharge head opening by a retainer. The spout valve includes a slit at a first end thereof and an orifice at a second opposite end thereof. The slit includes slit lips directly engageable with and disengageable from each other to respectively define slit closed and opened configurations. The spout valve is made of a material for permitting opening of the slit under pressure from the liquid product for thereby allowing the liquid product to be discharged out through the slit when in the slit opened configuration, and for otherwise permitting closing of the slit to prevent the liquid product from being discharged through the slit when in the slit closed configuration.

15 Claims, 1 Drawing Sheet

U.S. PATENT DOCUMENTS

| | | | | |
|---|---|---|---|---|
| 6,290,108 | B1 | 9/2001 | Gross | |
| H2027 | H * | 6/2002 | Brown et al. | 215/260 |
| 6,427,874 | B2 | 8/2002 | Brown et al. | |
| 6,471,095 | B1 * | 10/2002 | Cann | 222/190 |
| 6,497,346 | B1 | 12/2002 | Dubois et al. | |
| 7,513,396 | B2 | 4/2009 | Pardes et al. | |
| 7,516,874 | B2 | 4/2009 | Kneer | |
| 2001/0025863 | A1 | 10/2001 | Lorcheidt et al. | |
| 2002/0074356 | A1 * | 6/2002 | Lewis et al. | 222/181.3 |
| 2003/0034362 | A1 * | 2/2003 | Blake | 222/321.9 |
| 2005/0115984 | A1 * | 6/2005 | Pritchett et al. | 222/95 |
| 2005/0211735 | A1 * | 9/2005 | Socier et al. | 222/494 |
| 2009/0101681 | A1 | 4/2009 | Dato et al. | |
| 2009/0108033 | A1 | 4/2009 | Quinn et al. | |

FOREIGN PATENT DOCUMENTS

| | | | |
|---|---|---|---|
| EP | 0864371 | A1 | 9/1998 |
| EP | 1716928 | A2 | 11/2006 |
| JP | 4-267758 | | 9/1992 |
| WO | 9814279 | | 4/1998 |
| WO | 03/028898 | A1 | 4/2003 |

* cited by examiner

FIG 1
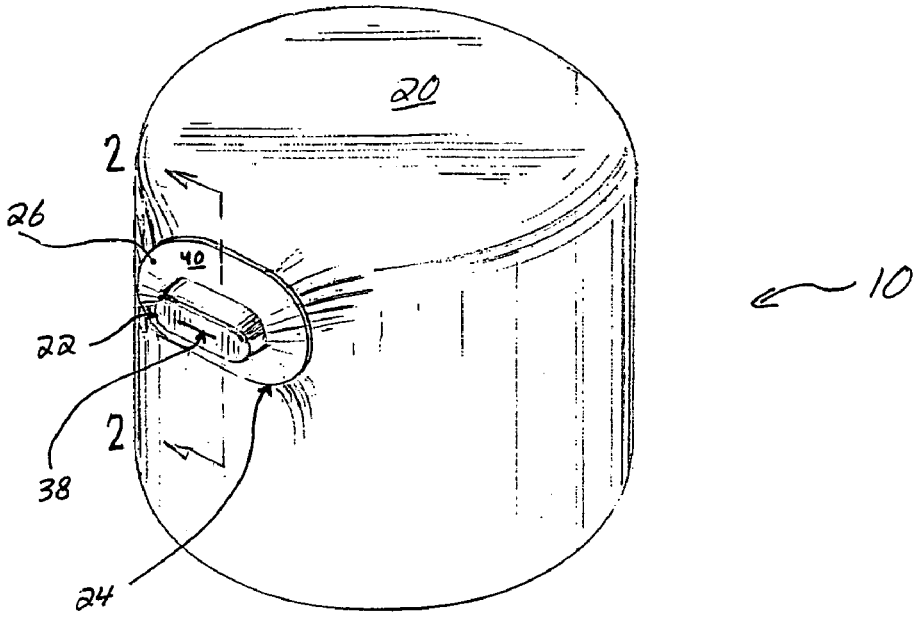
FIG 2
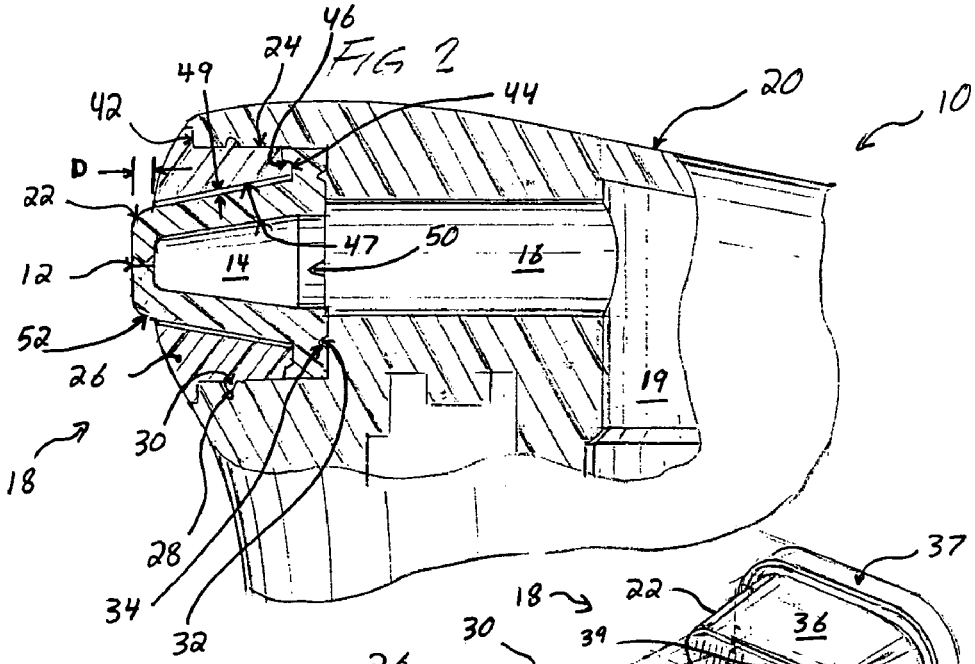
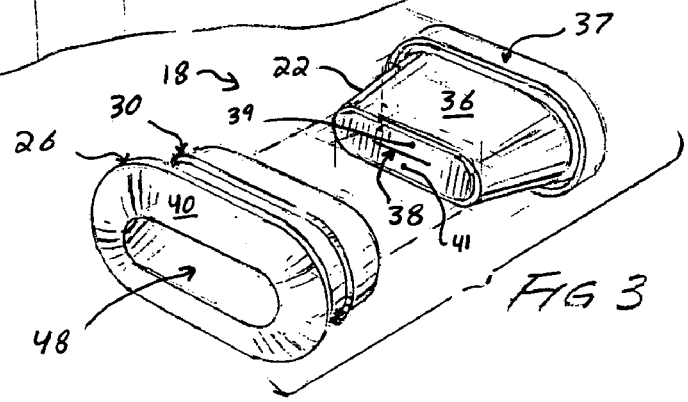
FIG 3

DISPENSER HAVING AIR TIGHT SPOUT

BACKGROUND OF INVENTION a. Field of Invention

The invention relates generally to improvements in pump dispensers, and more particularly to such pump dispensers having an improved spout valve assembly including an elastomeric one-way valve forming an air tight spout capable of quick shut-off of the discharge channel to prevent drying of product within the discharge channel.

b. Description of Related Art

The known manually actuated pump dispensers especially those designed for the dispensing of personal care products which may be in the form of pastes or gels, typically have both inlet and outlet check valves for respectively controlling the flow of liquid product into the pump chamber during each piston suction stroke and for controlling the outflow of the liquid product from the pump chamber during each piston compression stroke.

Such pump dispensers are advantageous in that they permit dispensing of products in a metered quantity over an extended period of use. However, extended use of many available pump dispensers often resulted in accumulation and drying of product at the dispenser head outlet or in the channel leading up to the outlet, which must be avoided from both an operational as well as hygienic point of view.

In order to address the drawbacks of product accumulation and drying with conventional pump dispensers, several valve designs have been proposed for sealing the channel leading up to the dispenser head outlet. U.S. Pat. No. 5,186,368 (hereinafter "the '368 Patent") and U.S. Pat. No. 5,447,258 (hereinafter "the '258 Patent") are exemplary of such a known pump dispensers. While the valve designs of the '368 and '258 Patents have improved upon conventional pump dispenser valve designs, as discussed below, these designs are nevertheless problematic in their own respect.

Specifically, referring to FIGS. 4 and 6 of the '368 Patent, the elastomer valve, referred to as a shutter 1, is mounted by telescoping it over a nipple (see FIG. 6) formed at the front end of pump head 2. Shutter 1 sealingly engages the nipple along the forward peripheral edge thereof as well as along the side periphery. Head 2 is disposed in sealed contact with side wall 11 of the shutter over a first surface which extends only over the inside of side wall 11, and the head is further disposed in sealed contact with the inside surface $210_i$ of end wall 10. These assembly requirements enable shutter 1 to be sealingly engaged with the nipple.

As readily evident from the description of the '368 Patent valve design, the valve assembly is disadvantageous in that shutter 1 can easily dislodge over repeated use because of the ineffective mounting thereof on the nipple of pump head 2. This tendency to dislodge is especially of concern when the shutter is subjected to pasty product under high pressure during pumping. Further, the shutter cannot otherwise be strengthened for enhancing its mounting with the head since it is of a one-piece construction, and the shutter can only be rigidified to a certain degree since sufficient elasticity is needed for opening and closing the slit.

Turning now to the valve design of the '258 Patent, referring to FIG. 1 of the '258 Patent, the valve assembly includes first and second valve bodies 7, 11 partially retained within the dispenser head by stopper 22. Valve body 11 is specifically retained within the dispenser head by engaging part 8 disposed in contact with projection 3 a on one side of part 8 and stopper surface 22b on the other side thereof. Valves 7 and 11 operate by means of their engagement at location 10 (denoted opening part 10), where valve body 11 is disposed in sealing engagement with shaft 6 of valve 7. Thus, during downward pressing of head 20, product enters from pipe 2 into the space between valve 11 and shaft 6. When sufficient pressure is created, valve 11 expands radially to break the contact between end opening part 10 and shaft 6, and allow product to exit. Upon release of pressure on head 20, opening part 10 of valve 11 resumes contact with shaft 6 to seal the exit.

As readily evident from the description of the '258 Patent valve design, the valve assembly of the '258 Patent is disadvantageous in that it includes at least three components, namely valve bodies 7 and 11, and stopper 22 for effective sealing of the exit channel. Further, valve bodies 7 and 11, and stopper 22 are of relatively complicated designs. From a manufacturing point of view, for pump dispensers often made by the hundreds-of-thousands, the addition of a single component, as well as the preparation required for a relatively complicated mold can add significantly to the overall cost of the finished product. Further, as readily evident from the discussion above, while the valve assembly of the '258 Patent may provide adequate sealing of the outlet channel at early stages of dispenser operation, extended use of the '258 Patent pump dispenser invariably results in accumulation and drying of product at the dispenser head outlet due to product accumulation between opening part 10 and shaft 6.

In a similar manner as the '368 and '258 Patents, the spout valve designs of U.S. Pat. Nos. 6,497,346, 6,065,642 and 5,377,877 are problematic due to their complicated operation and assembly, and further due to the inadequate mounting thereof to the dispenser head.

It would therefore be of benefit to provide a pump dispenser having an improved elastomeric spout valve which both facilitates easier and more economical manufacture and assembly of the pump dispenser, which securely remains mounted to the dispenser head over the life of the pump dispenser for reducing or virtually eliminating the odds of the valve being dislodged from the dispenser head, regardless of pressures required for opening the valve slit, and which is robust in design and efficient in operation. It would also be of benefit to provide a spout valve which will quickly respond for sealing the discharge flow path during each piston suction stroke irrespective of the viscosity of the product being dispensed.

SUMMARY OF INVENTION

The invention solves the problems and overcomes the drawbacks and deficiencies of prior art pump dispenser designs by providing in combination an improved deformable spout valve which both facilitates manufacture and assembly of the pump dispenser, which securely remains mounted to the dispenser head over the life of the pump dispenser, regardless of pressures required for opening the spout valve slit, and which provides repeatability in the cross-sectional quality of the discharged product over the life of the pump dispenser.

The present invention thus provides a manual pump dispenser including a discharge head reciprocable between pressure and return strokes. The pump dispenser may include a spout valve assembly located within an opening in the discharge head. The spout valve assembly permits outletting of liquid product through a passage in fluid communication with the discharge head opening during each of the pressure strokes, and includes a spout valve retained substantially within the discharge head opening by a retainer. The spout valve may be disposed within an opening in the retainer, and include a slit at a first end thereof and an orifice at a second opposite end thereof. The slit may include slit lips directly engageable with each other to define a slit closed configuration and disengageable from each other to define a slit opened configuration. The spout valve may be made of a material for permitting predetermined opening of the slit under pressure from the liquid product during each of the pressure strokes for thereby allowing the liquid product to be discharged out through the slit when in the slit opened configuration, and for otherwise permitting rapid closing of the slit to prevent the liquid product from being discharged through the slit when in the slit closed configuration.

For the pump dispenser described above, the slitted first end of the spout valve may protrude out through the retainer opening beyond an outer surface profile of the discharge head to prevent liquid product from accumulating within the retainer opening. The retainer may fixedly retain the spout valve within the discharge head opening by the provision of an annular rib disposed within an annular groove for providing a snap-fit engagement between the retainer and the discharge head. The retainer may include a flange at an inner end thereof engageable with a complementary flange provided adjacent the second opposite end of the spout valve for fixedly retaining the spout valve within the discharge head opening. The spout valve may include a section tapered toward the slit. The retainer opening may include a complementary taper as the spout valve tapered section to securely retain the spout valve within the retainer opening. The spout valve may be formed of a silicone and/or a thermoplastic elastomer.

The present invention further provides a spout valve assembly for a manual pump dispenser including a discharge head reciprocable between pressure and return strokes. The spout valve assembly may be located within an opening in the discharge head. The spout valve assembly permits outletting of liquid product through a passage in fluid communication with the discharge head opening during each of the pressure strokes, and includes a spout valve retained substantially within the discharge head opening by a retainer. The spout valve may be disposed within an opening in the retainer, and include a slit at a first end thereof and an orifice at a second opposite end thereof. The slit may include slit lips directly engageable with each other to define a slit closed configuration and disengageable from each other to define a slit opened configuration. The spout valve may be made of a material for permitting predetermined opening of the slit under pressure from the liquid product during each of the pressure strokes for thereby allowing the liquid product to be discharged out through the slit when in the slit opened configuration, and for otherwise permitting rapid closing of the slit to prevent the liquid product from being discharged through the slit when in the slit closed configuration.

For the spout valve assembly described above, the slitted first end of the spout valve may protrude out through the retainer opening beyond an outer surface profile of the discharge head to prevent liquid product from accumulating within the retainer opening. The retainer may fixedly retain the spout valve within the discharge head opening by the provision of an annular rib disposed within an annular groove for providing a snap-fit engagement between the retainer and the discharge head. The retainer may include a flange at an inner end thereof engageable with a complementary flange provided adjacent the second opposite end of the spout valve for fixedly retaining the spout valve within the discharge head opening. The spout valve may include a section tapered toward the slit. The retainer opening may include a complementary taper as the spout valve tapered section to securely retain the spout valve within the retainer opening. The spout valve may be formed of a silicone and/or a thermoplastic elastomer.

The present invention yet further provides a spout valve assembly for a pump dispenser including a discharge head. The spout valve assembly may be located within an opening in the discharge head. The spout valve assembly permits outletting of liquid product through a passage in fluid communication with the discharge head opening, and includes a spout valve retained substantially within the discharge head opening by a retainer. The spout valve may be disposed within an opening in the retainer, and include a slit at a first end thereof and an orifice at a second opposite end thereof. The slit may include slit lips directly engageable with each other to define a slit closed configuration and disengageable from each other to define a slit opened configuration. The spout valve may be made of a material for permitting predetermined opening of the slit under pressure from the liquid product for thereby allowing the liquid product to be discharged out through the slit when in the slit opened configuration, and for otherwise permitting rapid closing of the slit to prevent the liquid product from being discharged through the slit when in the slit closed configuration.

For the spout valve assembly described above, the slitted first end of the spout valve may protrude out through the retainer opening beyond an outer surface profile of the discharge head to prevent liquid product from accumulating within the retainer opening. The retainer may fixedly retain the spout valve within the discharge head opening by the provision of an annular rib disposed within an annular groove for providing a snap-fit engagement between the retainer and the discharge head. The retainer may include a flange at an inner end thereof engageable with a complementary flange provided adjacent the second opposite end of the spout valve for fixedly retaining the spout valve within the discharge head opening. The spout valve may include a section tapered toward the slit. The retainer opening may include a complementary taper as the spout valve tapered section to securely retain the spout valve within the retainer opening. The spout valve may be formed of a silicone and/or a thermoplastic elastomer.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings:

FIG. 1 is a perspective view of a pump dispenser head according to the present invention, illustrating a spout valve assembly;

FIG. 2 is a cross-sectional view of the pump dispenser, partly broken away, taken substantially along line 2-2, illustrating the various internal features of the spout valve assembly including a retainer and an elastomeric spout valve; and FIG. 3 is a perspective view of the spout valve assembly of FIG. 1 in a disassembled configuration, illustrating the retainer and the elastomeric spout valve.

DETAILED DESCRIPTION OF THE PREFERRED EMBODIMENTS

Turning now to the drawings wherein like reference characters refer to like and corresponding parts throughout the several views, a discharge head is generally designated 10 in FIG. 1, which is used with a manually actuated pump dispenser as represented by the type disclosed in U.S. Pat. No. 5,447,258 ("the '258 Patent"), being specifically incorporated herein by reference.

Briefly, the dispenser of the '258 Patent includes a pump housing which defines a pump cylinder having a pump piston disposed for reciprocation therein. The housing, which is open at its upper end is supported by a conventional container closure in the form of an internally threaded cap, which is adapted to support the pump housing within the interior of a container to dispense the liquid product from the container as desired. Supported at the upper end of the pump piston is a discharge head (designated pressure base 20), similar to discharge head 10 according to the present invention.

Turning now to FIGS. 1-3 of the present invention, discharge head 10 may include a slitted orifice 12 communicating through suitable passages 14, 16 with the hollow piston rod 19 for discharging the liquid product to the atmosphere. The upper surface 20 of the head may be conformed to receive downward finger pressure for the purpose of reciprocating the pump piston.

As shown in FIGS. 1 and 2, discharge head 10 may include a spout valve assembly 18 including spout valve 22 retained in discharge head opening 24 by means of a retainer 26. As can be seen by comparing FIGS. 1 and 2, in the embodiment illustrated, opening 24 may include a generally elliptical outer profile (see FIG. 1), and a generally rectangular inner profile (see FIG. 2). Opening 24 may further include a plurality of retention and alignment means for likewise retaining and aligning spout valve 22 and retainer 26 therein. In the specific embodiment illustrated, the retention means may include a groove 28 into which circumferentially disposed rib 30 of retainer 26 may fit for allowing a snap-fit engagement between retainer 26 and discharge head 10. As readily evident, the engagement of rib 30 and groove 28 facilitates alignment of retainer 26 within the opening of discharge head 10. Further, the alignment means may include conical rib 32 which projects into a complementary groove 34 within spout valve 22. It would be apparent to those skilled in the art in view of this disclosure that alternative retaining and alignment means may be provided without departing from the scope of the present invention. For example, instead of retainer 26 being snap-fitted to discharge head 10 as shown, a retainer 26 may be friction fitted or otherwise bonded within the opening in discharge head 10.

As illustrated in FIGS. 2 and 3, spout valve 22 may include a generally tapered discharge section 36 and a retention section 37, and formed of a single piece. Tapered discharge section 36 may include a slit 38 normally disposed in a discharge closed position due to the elastic properties of the material, and otherwise disposed in a discharge open position upon actuation of head 10 in the known manner. Slit 38 may include upper and lower slit lips 39, 41, respectively, directly engageable with each other to define a slit closed configuration (see configuration of FIG. 3) and disengageable from each other to define a slit opened configuration. Valve 22 may further include orifice 50 for fluid communication with passage 16. Valve 22 may be formed of an elastomeric material as shown, or of another elastically deformable material for permitting the required opening and closing of slit 38 during pump actuation. Further, although slit 38 is illustrated as a linear slit, slit 38 may be readily formed of other configurations (i.e. star-shaped, curved etc.) to permit control of the discharge therethrough.

Referring to FIGS. 2 and 3, as briefly discussed above, retainer 26 may include a generally elliptical outer surface 40 sized to smoothly mate with countersunk opening 42 in discharge head 10. Retainer 26 may further include a rear flange 44 formed to mate with complementary flange 46 of spout valve 22, for tightly retaining the valve within the front opening of discharge head 10. An inner tapered opening 48 may be provided at the same taper angle as tapered discharge section 36 of valve 22. While the embodiment of FIG. 2 illustrates a small tolerance 49 between the respective surfaces 36, 47, it should be noted that valve 22 and opening 48 may be sized for a tighter fit, as would be apparent to those skilled in the art. Retainer 26 may be formed of a plastic (i.e. polyethylene, polypropylene etc.) or other rigid material for providing adequate retention of valve 22 within opening 24.

With retainer 26 and valve 22 thus assembled as shown in FIG. 2, it can be seen that the head of valve 22 extends slightly downstream by a distance D from outer surface 40 of retainer 26. This extension from surface 40 enables the exposed portion 52 of valve 22 to allow product discharge at a predetermined distance from surface 40 and thus prevents product from accumulating adjacent opening 48 of retainer 22.

Those skilled in the art would appreciate that the reverse taper of surfaces 36, 47 of valve 22 and retainer 26 may be provided and functions equally well in all these type of dispensers to retain the valve positively in place without dislodgement even under extreme and repeated high pressures of the dispensed fluids.

The operation of discharge head 10 will now be described in detail with reference to FIGS. 1-3.

Specifically, once the pump for discharge head 10 is primed and the pump chamber is partially filled with the liquid product to be dispensed, together with a residual amount of air and/or liquid vapor, downward finger pressure on head 10 will initiate downward movement of the pump piston on its operative stroke. Throughout the initial portion of the stroke, the main discharge valve (not shown) will be retained in a closed position by upward pressure of the pump spring. As such downward movement continues, however, the main discharge valve will open such that liquid product is discharged through hollow piston rod 19, through passages 14, 16, and out thorough slit 38.

Thereafter, when finger pressure on head 10 is released, the piston commences its upward stroke, by energy stored in the pump spring. Upward movement of the piston produces a pressure drop in the pump chamber, causing liquid to be sucked into the pump chamber via a dip tube, in readiness for a further downward stroke. During the upward stroke, slit 38 remains in a closed configuration.

The assembly of discharge head 10 will now be described with reference to FIGS. 1-3.

Specifically, in order to assemble discharge head 10, spout valve 22 may be disposed within opening 24 within head 10, and thereafter, retainer 26 may be snap-fitted within opening 24 with valve 22 already in place. Alternatively, as shown in FIG. 3, spout valve 22 and retainer 26 may be assembled such that spout valve 22 is disposed within opening 48 of retainer 26 prior to insertion within opening 24, and thereafter, the valve assembly may be inserted within opening 24 of discharge head 10. In either case, it can be seen that a simple yet effective means is provided for retaining valve 22 within discharge head 10.

The spout valve assembly according to the present invention thus provides several benefits over those of the prior art.

For example, spout valve assembly 18 including spout valve 22 and retainer 26 facilitates assembly of the pump dispenser, and is further securely disposed at an end of the discharge head nozzle for reducing or virtually eliminating the odds of valve 22 being dislodged from discharge head 10. During shipment and periods of non-use, slit 38 effectively seals passage 14 from atmosphere, thus preventing leakage of product from passage 14 and further preventing drying of product within passage 14. The spout valve assembly according to the present invention also avoids the need for any means acting between spout valve 22 and discharge head 10 for retaining the valve in place, as evident with conventional valve assemblies, as such retention means are often inadequate for preventing dislodgement of the spout valve from the pump head. Yet further, contrary to conventional valve assemblies, the valve assembly of the present invention does not require any specific portion of the elastomeric valve to be sealed with the discharge head, but simply provides the required sealing upon the snap-fit engagement of retainer 26. Moreover, valve assembly 18 includes only two components, i.e. valve 22 and retainer 26, which from a manufacturing point of view provide an extremely cost-effective pump dispenser design.

As discussed above, various modifications may be made to the spout valve assembly without departing from the scope of the present invention. For example, although a single outlet slit 38 is illustrated in FIG. 3, a plurality of slits may be employed for altering the cross-section of the product output. Further, while the spout valve assembly has been illustrated herein for a manually operated pump dispenser, those skilled in the art would also appreciate in view of this disclosure that the spout valve assembly may be used with squeeze or non-manually operated pump dispensers as well, i.e. a dispenser having a manually deformable side wall or wall portion, or a dispenser having a pump motor for discharging liquid product. It should also be noted that although the spout valve assembly has been described as being used in addition to a separate discharge valve provided within the pump dispenser, the spout valve assembly may be readily used in addition to or in lieu of a separate discharge valve provided within the pump dispenser, as would be apparent to those skilled in the art.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

What is claimed is:

1. A manual pump dispenser including a discharge head reciprocable between pressure and return strokes, said pump dispenser comprising:

a spout valve assembly located within an opening in said discharge head, an annular groove located within said discharge head opening;

said spout valve assembly permitting outletting of liquid product through a passage in fluid communication with said discharge head opening during each of said pressure strokes, the assembly including a spout valve retained substantially within said discharge head opening by a retainer, said retainer having on an outer surface an annular rib, said annular rib being disposed within said annular groove, said spout valve being disposed within an opening in said retainer, and including a slit at a first end thereof and an orifice at a second opposite end thereof, said slit including slit lips directly engageable with each other to define a slit closed configuration and disengageable from each other to define a slit opened configuration, said spout valve being made of a material for permitting predetermined opening of said slit under pressure from the liquid product during each of said pressure strokes for thereby allowing the liquid product to be discharged out through said slit when in said slit opened configuration, and for otherwise permitting rapid closing of said slit to prevent the liquid product from being discharged through said slit when in said slit closed configuration, wherein said spout valve includes a tapered section that tapers to the first end of said spout valve and said retainer opening includes a tapered wall that extends in a complementary manner adjacent the tapered section of the spout valve during both the pressure and return strokes of the pump dispenser, wherein the tapered section and the tapered wall have the same taper angle.

2. The pump dispenser according to claim 1, wherein the slit open configuration of the slit lips of the spout valve alone define a dispensing orifice for dispensing liquid product therefrom.

3. The pump dispenser according to claim 1, wherein said annular rib disposed within said annular groove provides a snap-fit engagement between said retainer and said discharge head opening.

4. The pump dispenser according to claim 1, wherein said slitted first end of said spout valve protrudes out through said retainer opening beyond an outer surface profile of said discharge head to prevent liquid product from accumulating within said retainer opening.

5. The pump dispenser according to claim 1, wherein said retainer includes a flange at an inner end thereof engageable with a complementary flange provided adjacent said second opposite end of said spout valve for fixedly retaining said spout valve within said discharge head opening.

6. The pump dispenser according to claim 1, wherein said spout valve is formed of at least one of a silicone and a thermoplastic elastomer.

7. The pump dispenser according to claim 1, wherein said retainer is formed of a rigid plastic.

8. The pump dispenser according to claim 1, wherein the tapered section and the tapered wall are separated by only a small tolerance.

9. The pump dispenser according to claim 1, wherein the tapered section and the tapered wall are sized for a tight fit therebetween.

10. A pump dispenser comprising:

a discharge head;

an opening in the discharge head;

a countersunk opening in the discharge head at an exterior of the opening;

a discharge passageway in communication with the opening;

a spout valve positioned in the opening, comprising:

a retention section adjacent the discharge passageway;

a tapered discharge section extending from the retention section to an exterior of the opening; and a slit in an end of the tapered discharge section;

a retainer positioned in the opening to retain the spout valve in the opening, comprising:

an elliptical outer surface mated with the countersunk opening; and a tapered opening extending from the elliptical outer surface to an opposite end of the retainer, wherein the tapered opening has a taper angle equal to a taper angle of the tapered discharge section of the spout valve.

11. The pump dispenser of claim 10, wherein the slit further comprises:

an upper slit lip; and a lower slit lip, wherein the upper slit lip and lower slit lip are engaged with each other in a closed position and are at least partially disengaged in an open position.

12. The pump dispenser of claim 10, further comprising an orifice in the retention section wherein the orifice is in communication with the discharge passageway.

13. The pump dispenser of claim 10, wherein the slit further comprises a slit having a shape selected from the group consisting of a linear shape, a star-shape, and a curved shape.

14. The pump dispenser of claim 10, further comprising:

a rear flange in the retainer; and a complementary flange in the spout valve mated with the rear flange.

15. The pump dispenser of claim 10, wherein the tapered discharge section extends a distance beyond the elliptical outer surface of the retainer.

* * * * *